US006436062B1

(12) United States Patent
Iwamoto et al.

(10) Patent No.: US 6,436,062 B1
(45) Date of Patent: Aug. 20, 2002

(54) MASSAGING APPLIANCE

(75) Inventors: Hironori Iwamoto; Ryuji Yamada, both of Shiga; Takaaki Yoshikawa, Osaka; Keiji Hata, Shiga; Yoshiyuki Miyake, Osaka; Mikio Ito, Shiga, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/424,789

(22) PCT Filed: Mar. 31, 1999

(86) PCT No.: PCT/JP99/01698

§ 371 (c)(1),
(2), (4) Date: Feb. 29, 2000

(87) PCT Pub. No.: WO99/51182

PCT Pub. Date: Oct. 14, 1999

(30) Foreign Application Priority Data

Mar. 31, 1998 (JP) ..... 10-087721

(51) Int. Cl.[7] ..... A61H 15/00
(52) U.S. Cl. ..... 601/122; 601/123; 601/125

(58) Field of Search ..... 601/118, 119, 601/129, 133, 134, 135, 122, 15.18, 73, 78

(56) References Cited

U.S. PATENT DOCUMENTS

| | | | | | |
|---|---|---|---|---|---|
| 2,193,249 | A | * | 3/1940 | Flanders et al. | 601/123 |
| 3,297,024 | A | * | 1/1967 | Robinson | 601/123 |
| 4,427,001 | A | * | 1/1984 | Kiefer et al. | 601/125 |
| 5,711,758 | A | * | 1/1998 | Tseng | 601/125 |
| 5,885,232 | A | * | 3/1999 | Guitay | 601/123 |

FOREIGN PATENT DOCUMENTS

| | | |
|---|---|---|
| JP | 6-75476 | 10/1994 |
| JP | 9-108286 | 4/1997 |

* cited by examiner

*Primary Examiner*—Michael A. Brown
(74) *Attorney, Agent, or Firm*—Burns, Doane, Swecker & Mathis, LLP

(57) ABSTRACT

A massager disposes a roller unit having a plurality of roller rows substantially parallel with each other at an outer periphery to which a vibration of a massage head is provided, the roller unit being swingable about an axial line substantially parallel with axial direction of the roller rows, whereby the plurality of substantially parallel roller rows can be stably engaged with the user's treating body part.

10 Claims, 11 Drawing Sheets

MASSAGING APPLIANCE

TECHNICAL FIELD

This invention relates to a massager provided, as rotatably supported at an end of a handgrip body, with a roller unit used as a contacting part with human body at an outer peripheral part, and with a vibration generator for providing to the roller unit a vibratory motion or, specifically, to a massager having a plurallity of generally parallel rows of massage rollers or, more specifically, to a massager capable of engaging a plurality of generally parallel rows of massage rollers with a human body part to be treated always in a stable manner.

1. Background Art

In the massager wherein the plurality of generally parallel rows of rollers at an end of the handgrip body are vibrated by the vibration generator, there has been adopted an arrangement designed for increasing massaging effect by means of the plurality of roller rows vibrated.

Depending on the human body part to be treated, however, there has been a problem that the generally parallel roller rows cannot be brought in touch with the treating part stably or evenly so that no sufficient massaging effect has been attained.

2. Disclosure of the Invention

An object of the present invention is to provide a massager which is capable of eliminating the foregoing problem, allowing the plurality of roller rows to be stably urged against the treating part all the time, and elevating the massaging effect.

According to the present invention, in this case, the above object can be established by means of a massager characterized in that a roller unit 2 provided with a plurality of generally parallel roller rows 2*a* and 2*b* is disposed on an outer face of a massage head rows 2*a* and 2*b* can be always urged against the treating part substantially vertically with respect to the part, and the plurality of roller rows 2*a* and 2*b* can be always stably urged for attaining a stable massage effect.

Other objects and advantages of the present invention shall become clear as the description of the invention advances with reference to embodiments of the invention shown in accompanying drawings.

Figure 1:
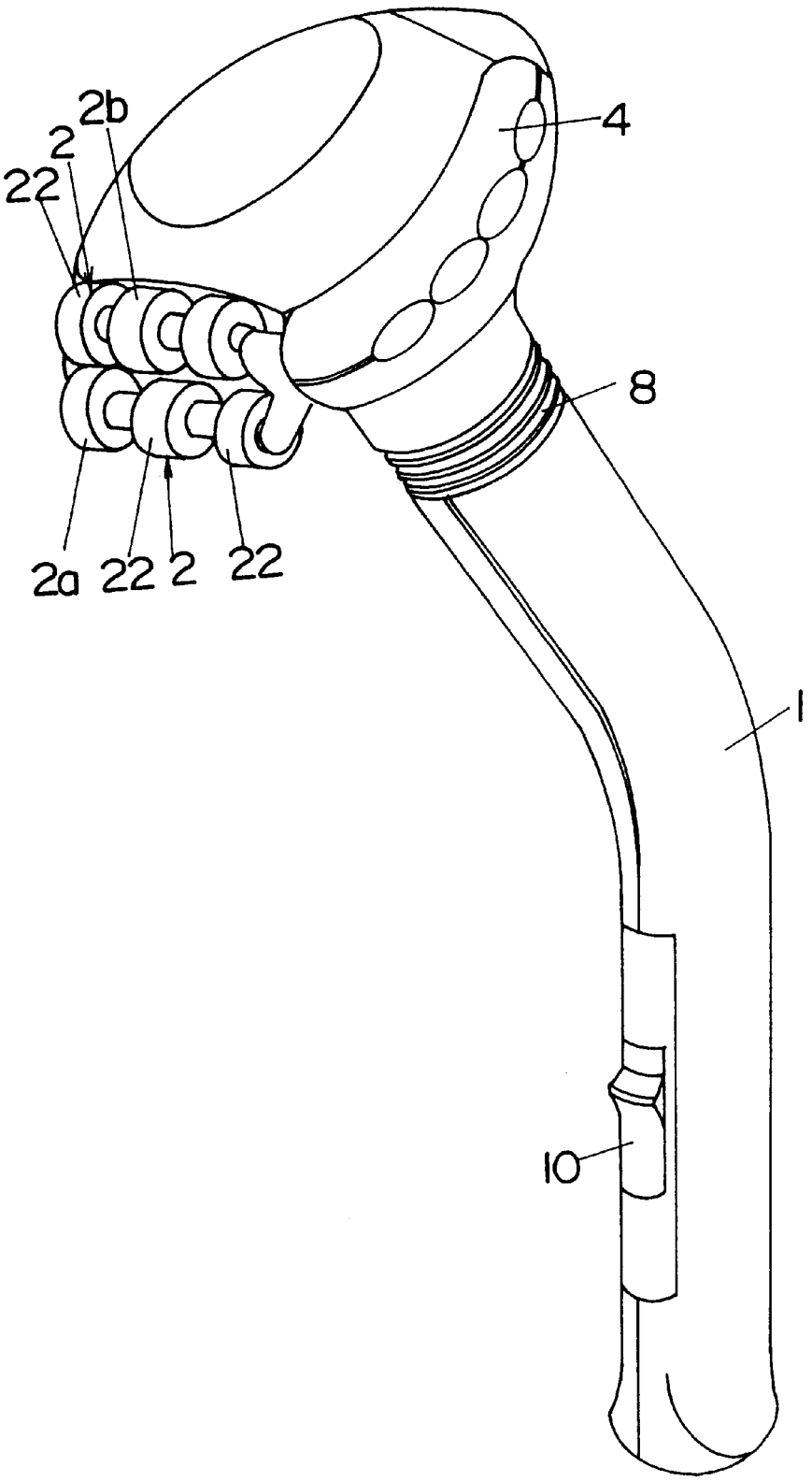
FIG. 1 shows in a perspective view a massager in an embodiment according to the present invention.

It should be appreciated that the present invention is not limited to the embodiments shown in the drawings, but rather to include all alterations and modifications possible in the scope of appended claims.

BEST MODE FOR CARRYING OUT THE INVENTION

In FIG. 1, there is shown an embodiment of the massager according to the present invention. In the present instance, the massager comprises a rod-shaped hardgrip body 1 gently bent at an end part, and a disk-shaped massage head 4 is coupled through a coupler 8 to the end part. A power source cord is led out of the other end of the handgrip body 1, and a switch 10 is disposed on the surface of the handgrip body 1.

Figure 5:
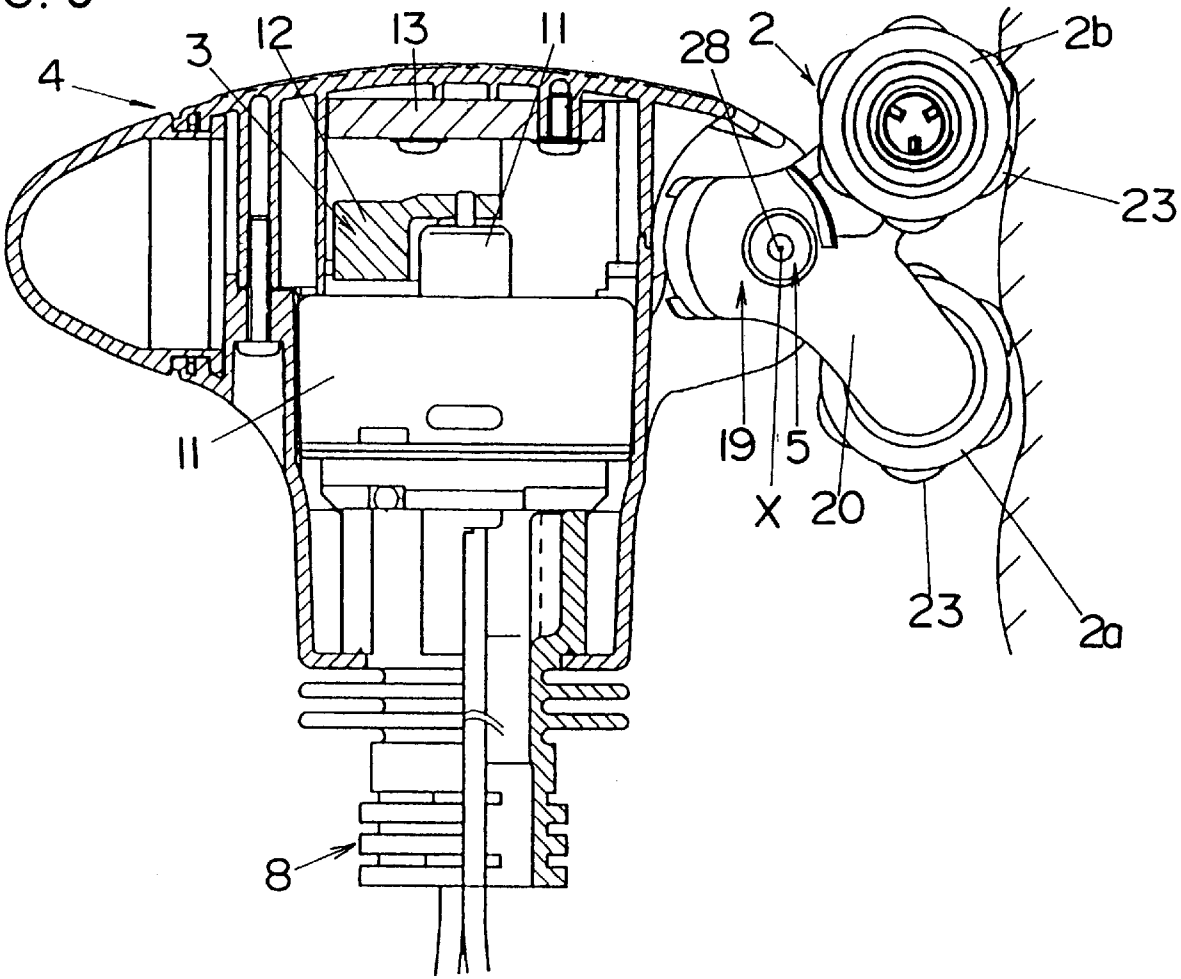
FIGS. 5 and 6 are explanatory views for the operation of the roller unit in the massager of FIG. 1, respectively.

As shown to details in FIG. 5, the massage head 4 incorporates therein a vibration generator 3 which comprises a motor 11 and an eccentric weight 12 mounted to an output shaft of the motor 11, and the arrangement is so made that the eccentric weight 12 is rotated by the motor 11 and the massage head 4 is vibrated. In the drawing, a reference 13 denotes a balance weight.

To outer periphery of the massage head 4 formed in the disk shape, the roller unit 2 is detachably mounted. The roller unit 2 comprises two parallel roller rows 2*a* and 2*b*, which are mounted to be swingable about an axis X substantially parallel with axial lines of the roller rows 2*a* and 2*b* with respect to the massage head 4. This arrangement shall be detailed in the followings.

Figure 2:
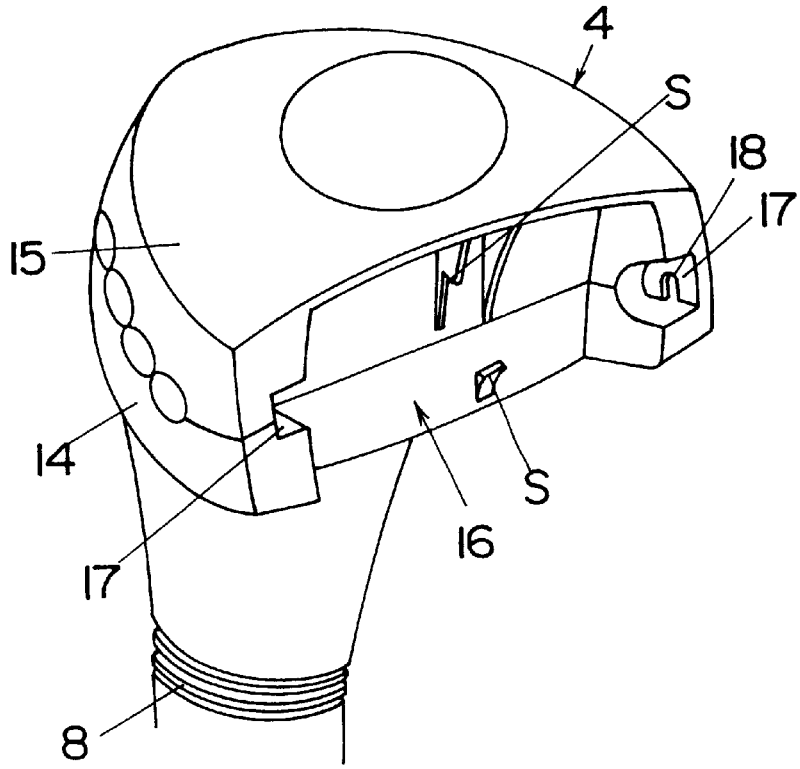
FIG. 2 is a schematic perspective view at a massage head with the roller unit dismounted.

Referring to FIG. 2, the massage head 4 with the roller unit 2 detached is constituted with a housing 14 and a cover 15 fitted to each other. A roller receptacle 16 is provided in a part of outer periphery of the massage head 4, and the roller receptacle 16 is provided at both side portions with engaging recesses 17, each of which recesses 17 includes a dent 18 for engaging therein a steel ball.

Figure 7:
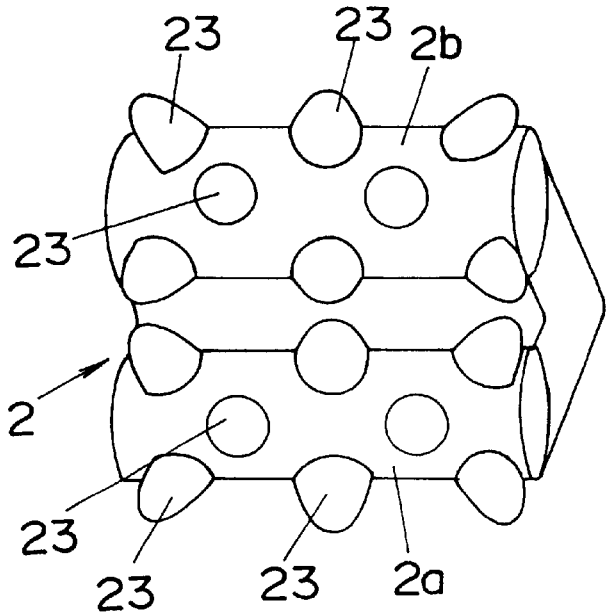
FIG. 7 is a schematic perspective view in another embodiment of the massager according to the present invention.
Figure 3B:
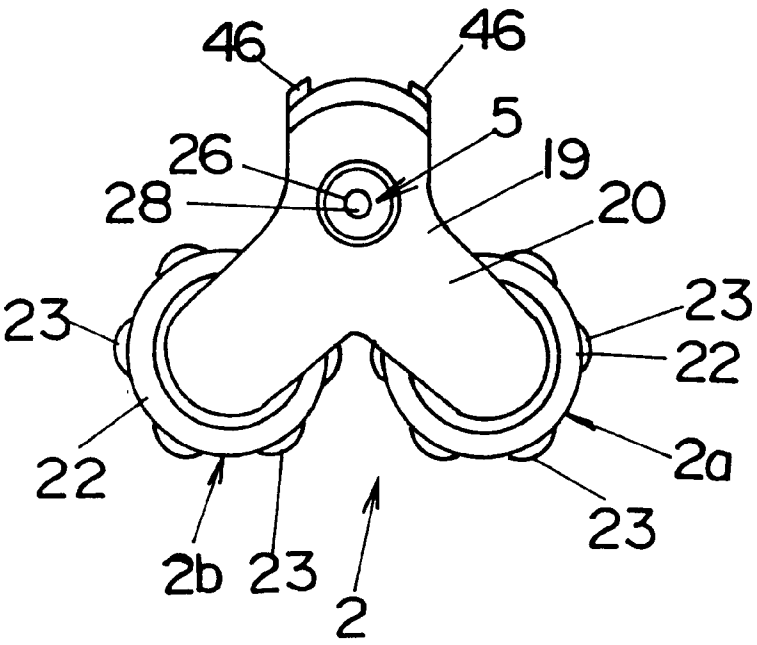
FIG. 3*b* is a side view of the roller unit in the massager of FIG. 1.
Figure 3A:
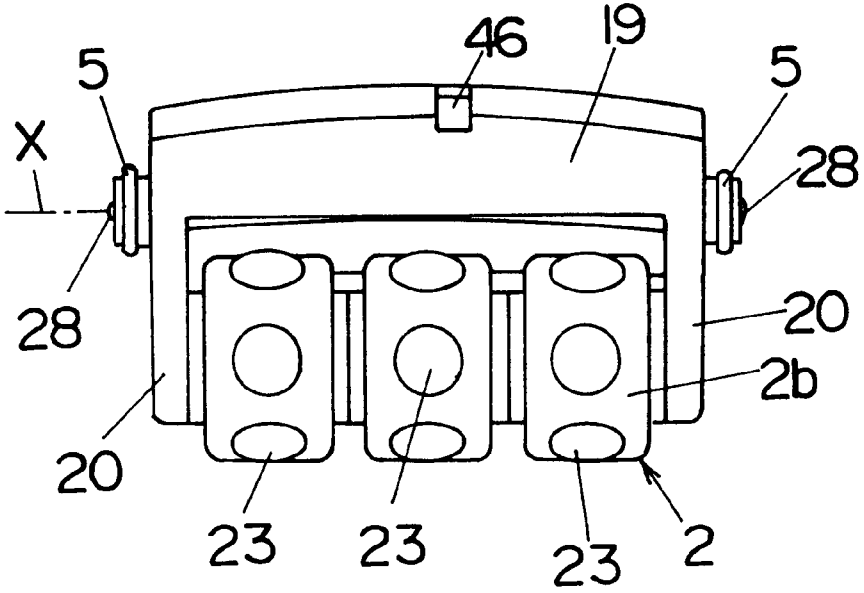
FIG. 3*a* is a plan view of the roller unit in the massager of FIG. 1.

Referring to FIGS. 3*a*, 3*b*, 4*a* and 4*b*, further, the roller unit 2 itself is depicted which comprises a roller support plate 19 substantially U-shaped in section (see FIG. 3*a*), both side plate parts 20 of which are respectively formed to be bifurcated, and the two roller rows 2*a* and 2*b* are supported to be mutually parallel between these side plate parts 20. In the roller rows 2*a* and 2*b*, rollers 22 are rotatably supported on holding shafts 21, while the rollers 22 are respectively formed to have protuberances 23 for elevating the massage effect. The protuberances can project from the rollers by selected distances, e.g., a short distance as shown in FIGS. 3*a*–3*b*, or a longer distance as shown in FIG. 7. Such rollers 22 may be of various shapes, and eventually the roller unit 2 may have various aspects. In the foregoing arrangement, on the other hand, it is also possible, as needed, to secure the rollers 22 non-rotatably to the holding shafts 21 with a welding means or the like.

Figure 4A:
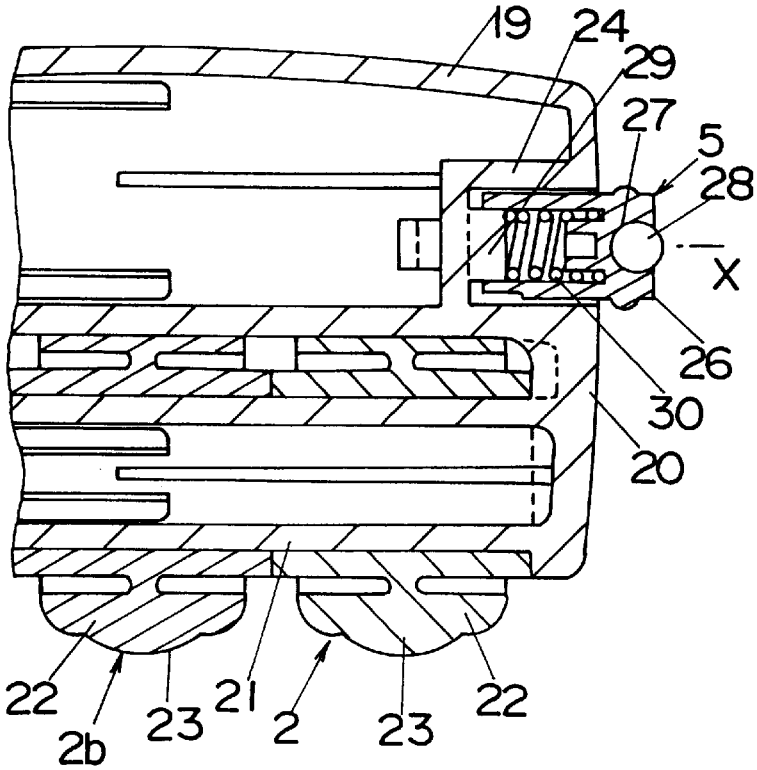
FIGS. 4*a* and 4*b* are fragmentary sectioned views as magnified respectively of the roller unit in the massager of FIG. 1.
Figure 4B:
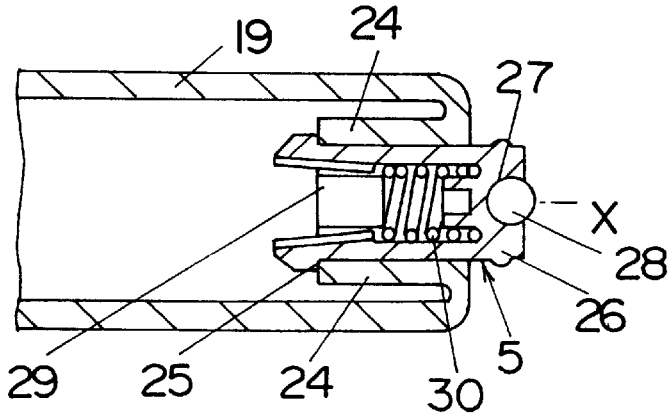
Figure 4C:
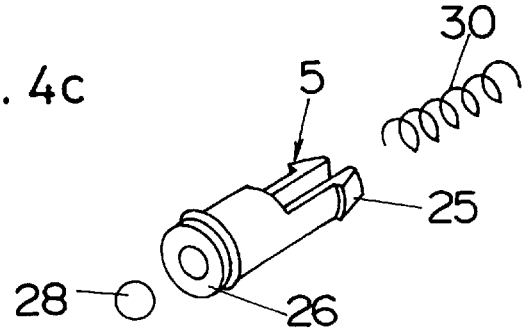
FIG. 4*c* is a fragmentary perspective view as disassembled of the roller unit in the massager of FIG. 1.

The side plate parts 20 include respective cylindrical parts 24 that project inwardly, as shown in FIGS. 4*a*, 4*b*. Roller support shafts 5 are provided in a cylindrical shape, a half portion of each of which is cut off to be resiliently deformable at an inner open end part. Engaging projections 25 are formed at the open inner end parts of the roller support shafts 5, and a hemispherical recess 27 is formed in the other head part 26 on a closed side of the roller support shafts 5, in which recess 27 a steel ball 28 is fitted (see FIG. 4*c*).

Now, the roller support shafts 5 are mounted to the roller support plates 19 by compressing a coil spring 30 received in each receptable 29 on the side of the roller support plate 19 by means of the roller support shaft 5, and locking the engaging projections 25 to inner end of each cylindrical part 24. In such mounted state, the arrangement is so made that the roller support shafts 5 are further urging (compressing) the coil springs 30 so as to be able to urge the roller supports shafts 5 inward of the roller support plate 19.

Figure 6:
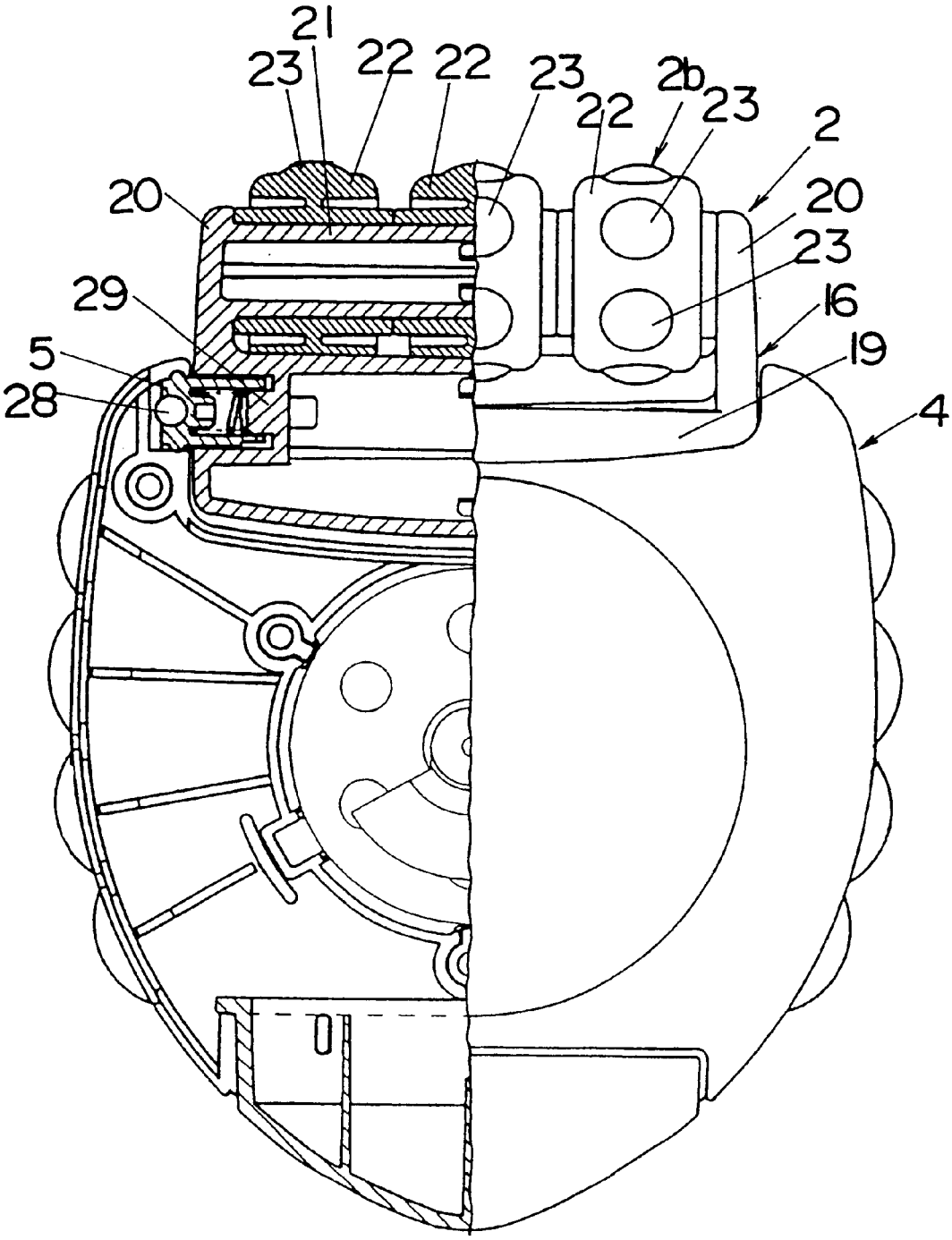

With the above arrangement, the roller unit 2 is mounted to the massage head 4 as shown in FIGS. 5 and 6 in that the head parts 26 of the roller support shaft 5, which are resiliently projecting out of both axial ends of the roller unit 2, are pushed inward by fingers of the user against a biasing force of the coil springs 30 and are then released to be engaged in the engaging recesses 17. Thus, the steel balls 28 are fitted in the dents 18 of the recesses 17, so that the roller unit 2 can be mounted to the massage head 4 to be swingable about the axis X passing through both steel balls 28.

Figure 8A:
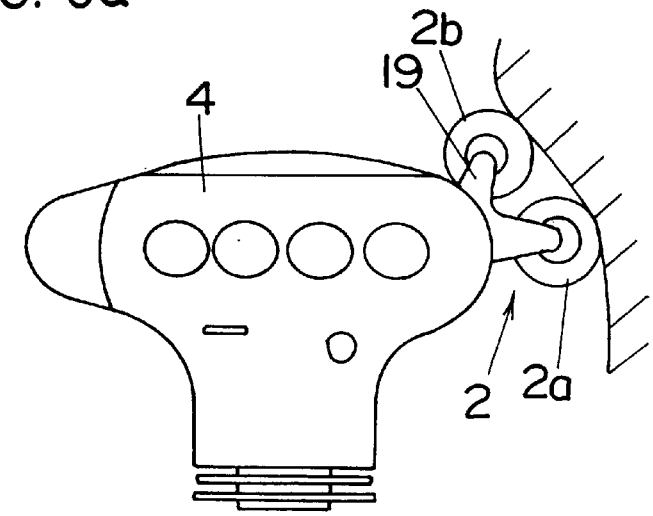
FIGS. 8*a* to 8*c* are explanatory views for the operation of the massager of FIG. 1, respectively.
Figure 8B:
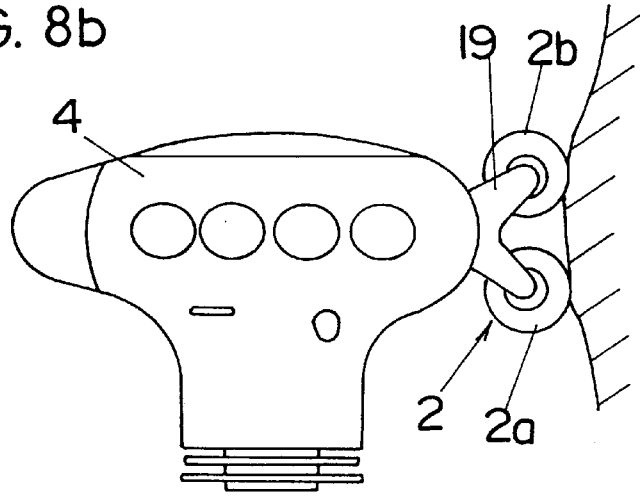
Figure 8C:
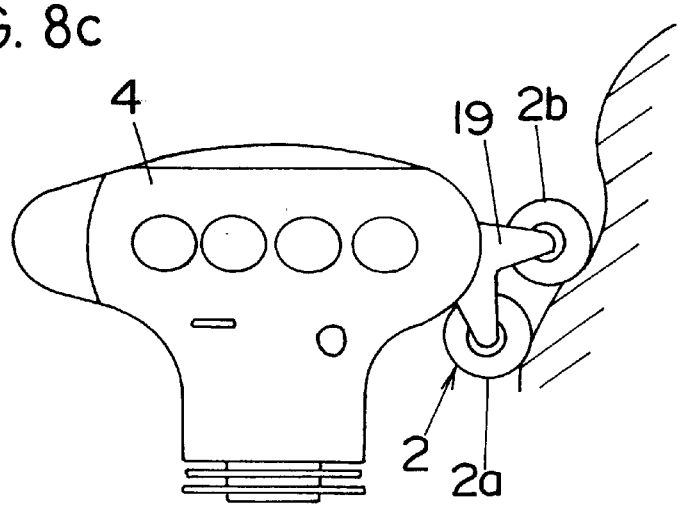

According to the foregoing arrangement, the roller unit 2 comprising a plurality of the roller rows 2*a* and 2*b* is to swing about the axis X which is substantially parallel with the axial lines of the roller rows 2*a* and 2*b*, and it is possible to apply the plurality of roller rows 2*a* and 2*b* always against the treating body part, and to obtain always a high massage effect (see also FIGS. 8*a* and 8*c*). Thus, in FIGS. 8*a* to 8*c* it is shown how the roller rows encounter different areas of unevenness of the body being massaged, and it becomes apparent from those foam figures how the roller unit 2 can rotate to adapt the roller rows 2*a*, 2*b* to the unevenness.

Further, when the roller unit 2 is manually pulled in a direction of separating the unit from the massage head 4, the steel balls 28 cause the roller support shafts 5 to be moved inward of the roller support plate 19 resisting against the force of the coil springs 30, the steel balls 28 are thereby retracted inward of the roller support plate 19, and it becomes possible to easily detach the roller unit 2 from the massage head 4. The mounting of the roller unit 2 to the massage head 4 can also be performed similarly through a reverse operation. Consequently, it becomes easier to selectively employ any desired shape of the roller unit. In the above arrangement, further, a stopper S is provided in the massage head 4, and a hook 46 of the roller unit 2 may be engaged with this stopper S for restricting the rotation of the roller unit 2.

Figure 9:
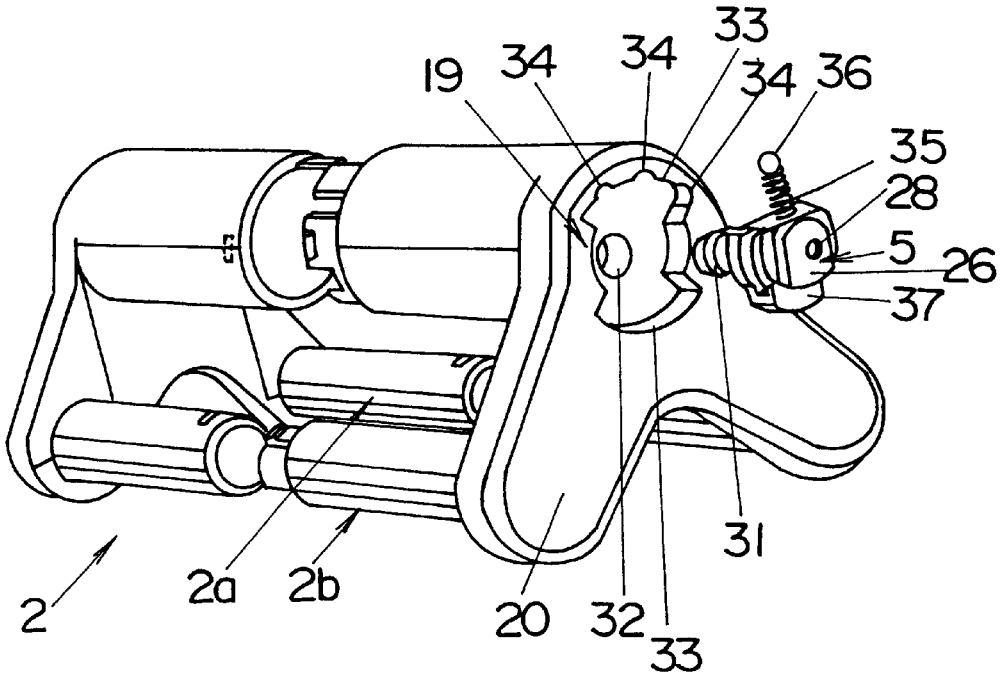
FIG. 9 is a fragmentary perspective view as disassembled of the roller unit in another embodiment of the present invention.

In another embodiment of the present invention as shown in FIG. 9, the basic arrangement is common to the foregoing embodiment, and common constituents are denoted by the same reference figures and symbols with their description omitted.

In the present embodiment, the head part 26 of the roller support shaft 5 is formed in a square shape, and this square head part 26 is engaged in the engaging recess 17 of the massage head 4 shown in FIG. 2 in non-rotatable manner. Further, a thin shaft 31 is extended from the roller support shaft 5 to be inserted in a small hole 32 in the side plate parts 20. Thus, the roller support shafts 5 are engaged to the massage head 4 non-rotatably, and such roller support shafts 5 support the roller unit 2 in rotatable manner.

In the side plate parts 20, two sector-shaped recesses 33 are formed to oppose each other with the small hole 32 as the center. In one recess 33, three dents 34 are provided. A coil spring 35 is mounted to the roller support shaft 5 and carries at its outer tip end a ball 36 as secured thereto by a welding means or by engaging a tip end of the coil spring 35 in a hole made in the ball 36. Inside the coil spring 35, a guide support rod is provided which projects from the roller support shaft 5 toward the ball 36 so that the ball 36 can be fitted in the dent 34, while the coil spring 35 can be compressed in the axial direction of the guide support rod and supported so as not to cause any remarkable deformation. On the side opposite to the coil spring 35, the roller support shaft 5 is formed to have a slide projection 37. In the state where the roller unit 2 is mounted to the massage head 4, therefore, the ball 36 on the side of the roller support shafts 5 is made to engage in one of the dents 34, and thereby the rotating position of the roller unit 2 can be fixed. In this event, the side projection 37 on the side of roller support shafts 5 may be brought into contact with opposing wall in the other recess 33.

Next, in altering the position of the roller unit 2 with the unit rotated, a manual rotation of the roller unit 2 causes the unit 2 to be rotated about the axis X of the roller unit 2, the ball 36 on the side of the roller support shaft 5 is made to be accommodated in next dent 34, so that the roller unit 2 can be fixed at the rotated position.

In this embodiment shown in FIG. 9, the position of the roller rows 2*a* and 2*b* fitting to the treating body part can also be fixed for improving the massage effect.

Figure 10:
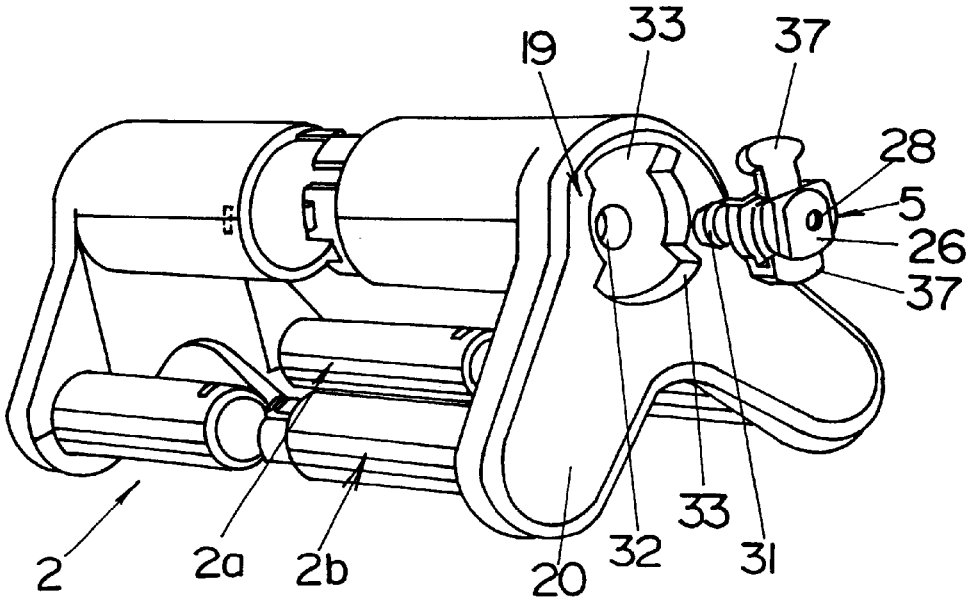
FIG. 10 is a fragmentary perspective view as disassembled of the roller unit in still another embodiment of the present invention.

In another embodiment of the present invention as shown in FIG. 10, the basic arrangement is common to the foregoing embodiment of FIG. 9, and common constituents are denoted by the same reference numerals with their description omitted.

In the present embodiment, the arrangement is so made that the roller support shafts 5 are provided respectively with two slide projections 37 which engage a wall surface of each of the sector-shaped recesses 33, so that a swing angle of the roller unit 2 can be restricted in a predetermined range. In the present embodiment, any excess swinging of the roller unit 2 can be prevented by restricting the size of the recesses 3.

Figure 11A:
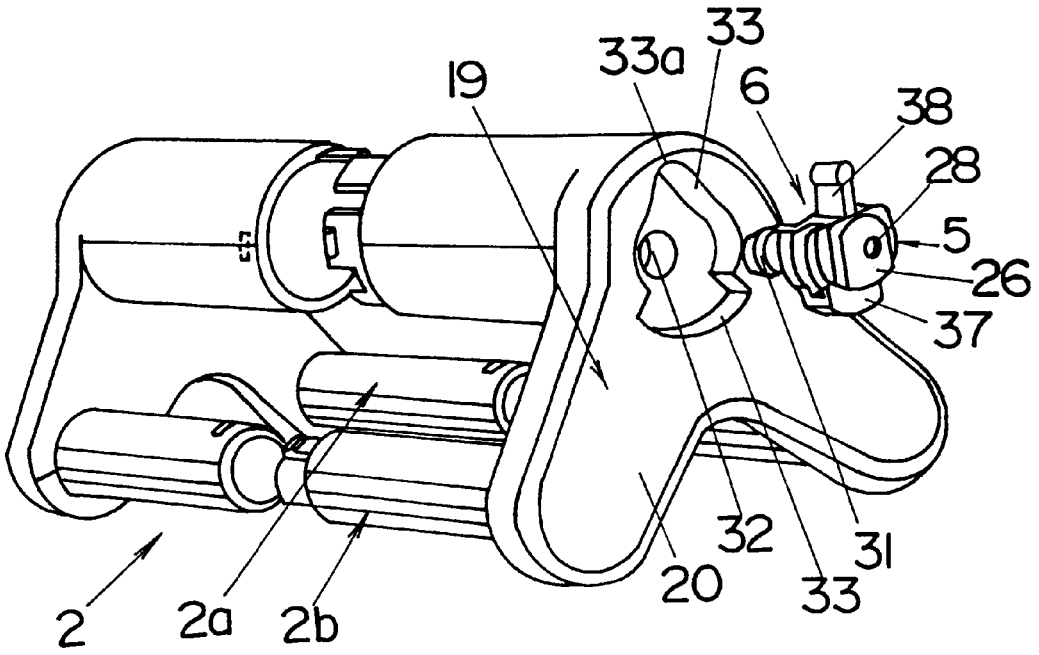
FIG. 11*a* is a fragmentary perspective view as disassembled of the roller unit in still another embodiment of the present invention.
Figure 11B:
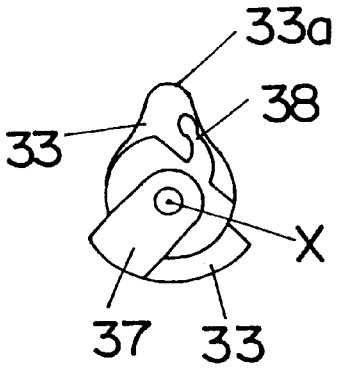
FIGS. 11*b* and 11*c* are explanatory views of the operation of the massager in FIG. 11*a*, respectively.
Figure 11C:
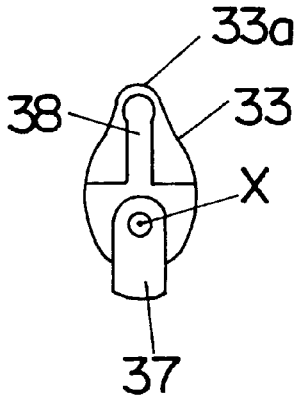

In still another embodiment of the present invention as shown in FIGS. 11*a*–11*c*, an upper side one of the recesses 33 in the foregoing embodiment is formed substantially as a triangle, while the roller support shaft 5 is provided with an elastic plate-shaped arm 38, and the arrangement is so made that, due to a restoring force of the arm 38 towards an apex 33*a* of the upper recess 33, the swing position of the roller unit 2 is reset to a predetermined position. This embodiment is common in the basic arrangement to the foregoing embodiment of FIG. 9, and common constituents are denoted in the drawing with the same reference numerals, while omitting their description.

In the present embodiment, a task of resetting the roller unit 2 to the predetermined position upon changing the treating body portion is performed by the elasticity of the arms 38, to be able to render the operability excellent.

Figure 12A:
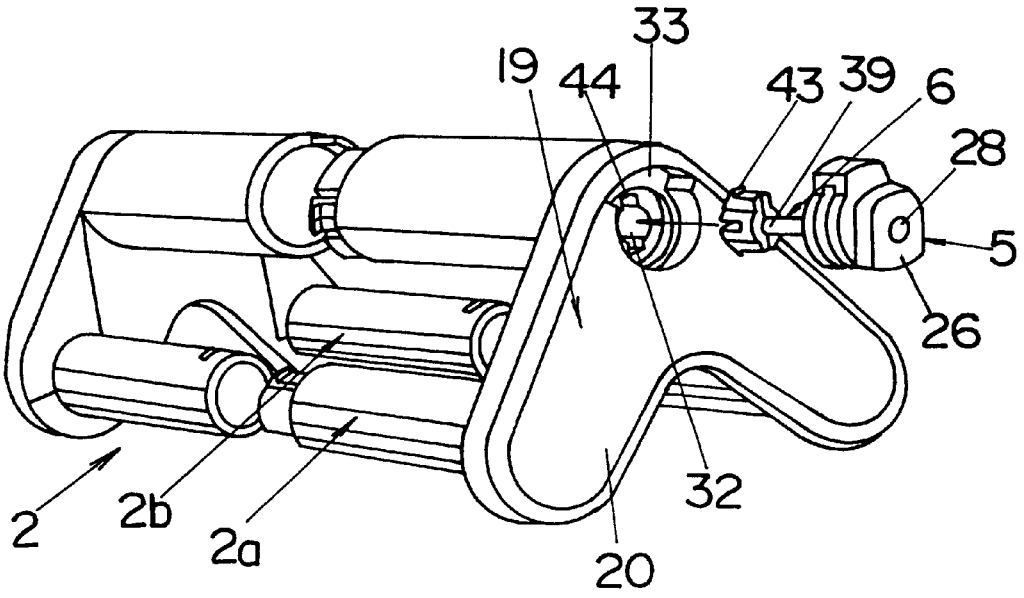
FIG. 12*a* is a fragmentary perspective view as disassembled of the roller unit in still another embodiment of the present invention.
Figure 12B:
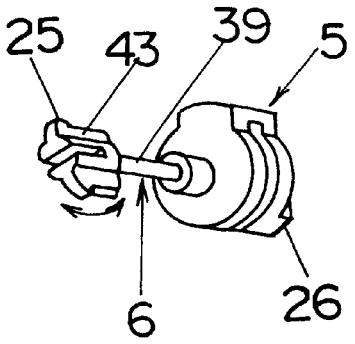
FIG. 12*b* is a perspective view of a roller support shaft in the embodiment of FIG. 12*a;*
Figure 12C:
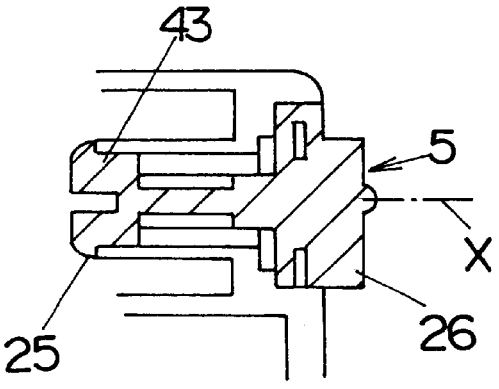
FIG. 12*c* is an explanatory view for an engaging state of the roller support shaft and the massage head in the embodiment of FIG. 12*a*.

In another embodiment according to the present invention as shown in FIGS. 12*a*–12*c*, the arrangement is so made that engaging members 43 formed at a tip end of axial shaft 39 of the roller support shaft 5 are engaged non-rotatably in slits 44 formed in series in the small hole 32 of the plate 19. This axial shaft 39 may be formed from an elastic material capable of being twisted, while storing a resetting force to restore the roller unit 2 to the original position upon release of the twisting force. This embodiment is common in the basic arrangement to the foregoing embodiment of FIG. 9, and common constituents are denoted by the same reference numerals while omitting their description.

In the present embodiment, the roller unit 2 is connected to the side of the massage head 4 through a non-circular head 26 of the roller support shaft 5 so that when the axial shaft 39 is twisted when the roller unit rotates, a biasing force for resetting the roller unit 2 back to the predetermined position is attained, because the axial shaft 39 acts as a torsion bar.

Figure 13:
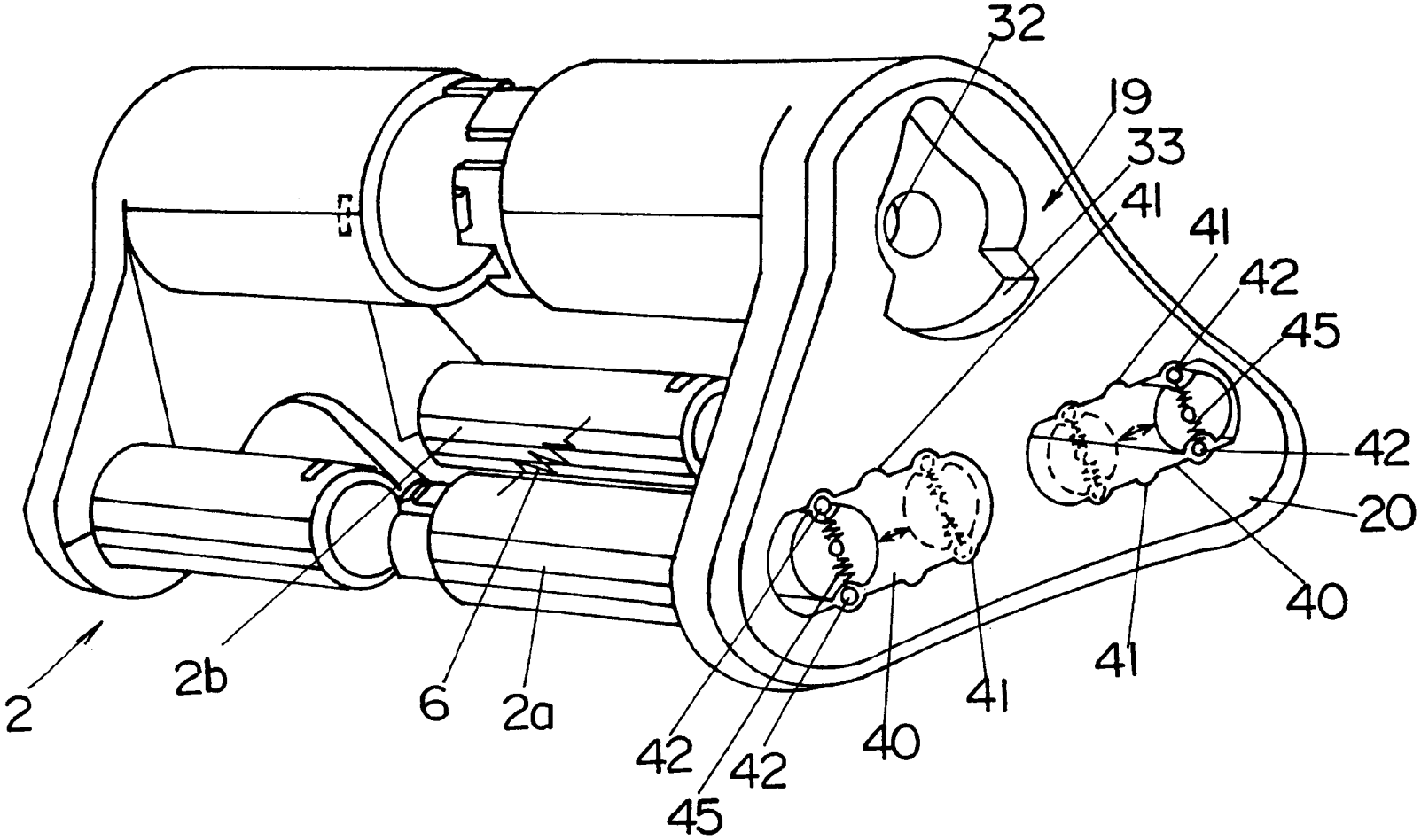
FIG. 13 is a perspective view of the roller unit in still another embodiment of the present invention.

In still another embodiment according to the present invention as shown in FIG. 13, the side plates 20 of the roller support plates 19 are formed to have slots 40 spaced apart in a longitudinal direction of these slots 40. Positioning balls 42 are radially biased by springs 45 to project from end parts of the respective roller rows 2*a* and 2*b* and are received in one of a plurality of sets of dents 41. The arrangement is such that the roller rows 2*a* and 2*b* disposed substantially parallel to each other can be shifted as the balls 42 of the roller rows 2*a* and 2*b* move from one set of dents 41 to another. This embodiment is common in the basic arrangement to the foregoing embodiment of FIG. 1, and common constituent are denoted by the same reference numerals while omitting their description.

In the present embodiment, the pitch between the roller rows 2*a* and 2*b* is varied to be more well fitted to the treating parts at the user's back, limbs and so on, and the massage effect can be elevated.

A biasing spring 6 is disposed between the substantially parallel roller rows 2*a* and 2*b* so that the roller rows 2*a* and 2*b* may be automatically reset to the original position. This biasing spring 6 is a tension spring and its mounting arrangement with respect to the roller rows 2*a* and 2*b* may be accomplished in any other suitable manner as desired.

What is claimed is:

1. A massager in which a massage head disposed at an end of a handgrip body detachably supports a roller unit including rollers of which an outer peripheral part forming a contacting part with the human body, a vibration generator is provided in the massage head, the rollers are disposed as a plurality of roller rows at an outer surface of the massage head to which a vibratory motion of the vibration generator is provided, the roller rows being substantially parallel to each other, and a support means supports the roller unit for swinging motion about an axis substantially parallel to axial direction of the roller rows, wherein at least one of the massage head and the roller-unit support means is provided with means for restricting the swing motion of the roller unit to be of a predetermined angular range.

2. The massager according to claim 1 wherein the swinging-motion restricting means comprises a stopper provided to the massage head to project out of an opposing part of the massage head with respect to the roller-unit support means, and a pair of projections projected out of an opposing part of the roller-unit support means with respect to the massage head, the projections respectively engaging the stopper at one of two extreme positions of the predetermined angular range of the swinging motion of the roller unit.

3. The massager according to claim 1 wherein the swing-motion restricting means comprises means provided in the roller-unit support means for restricting axial rotation of the roller-unit support means in the roller unit with respect to the massage head.

4. The massager according to claim 3 wherein the roller-unit support means comprises a roller support plate including a pair of side plate parts coupled to both ends of the roller rows and a body part connecting both side plate parts, and a pair of roller support shafts fitted in both axial end holes of the body part; and the rotation restricting means for the roller-unit support means comprises at least a sector-shaped recess made around each of the axial end holes of the body part and at least a slide projection projected radially from each of the roller support shafts into the sector-shaped recess.

5. The massager according to claim 4 wherein the roller-unit support means further comprises means for fixing the roller unit to at least a swing position, the wing-position fixing means including at least a dent made in outer peripheral all of the sector-shaped recess of the swing-motion restricting means, and locking means projected resiliently radially from each of the roller support shafts for sliding along the outer peripheral wall of the sector-shaped recess and resiliently in the dent so as to lock the swing-motion of the roller unit at a swung position.

6. The massager according to claim 4 wherein the roller-unit support means further includes a roller-unit resetting means comprising a substantially triangular recess made around the axial end holes on a side opposite to the sector-shaped recess of the swing-motion restricting means, and a plate-shaped arm projected form each of the roller-support shafts toward the triangular recess and to have a resiliency at least in bent direction so that the arm returns to the triangular recess.

7. The massager according to claim 4 wherein the roller-unit support means further includes a roller-unit resetting means comprising a torsion bar provided to each of the roller-support shafts so as to extend in axial direction of the shaft.

8. The massager according to claim 4 wherein the side plate parts of the roller support plate are supporting both ends of the roller rows to be movable in swinging direction of the roller unit, and a biasing means is provided between the respective roller rows for maintaining a predetermined interview between them.

9. The massager according to claim 1 wherein the roller-unit support means is further provided with means for releasably fixing the roller unit at a plurality of positions in the predetermined swinging angular range.

10. The massager according to claim 1 herein the roller-unit support means is further provided with means for biasing the roller unit which has swung in a resetting direction to a predetermined position.

* * * * *